US010679556B2

(12) United States Patent
Yang et al.

(10) Patent No.: US 10,679,556 B2
(45) Date of Patent: Jun. 9, 2020

(54) PIXEL CIRCUIT HAVING A SWITCHING CIRCUIT, A SHARED CIRCUIT, A FIRST SUB-PIXEL CIRCUIT AND A SECOND SUB-PIXEL CIRCUIT AND DRIVING METHOD THEREOF, DISPLAY PANEL

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/073,928

(22) PCT Filed: Dec. 15, 2017

(86) PCT No.: PCT/CN2017/116575
§ 371 (c)(1),
(2) Date: Jul. 30, 2018

(87) PCT Pub. No.: WO2018/205617
PCT Pub. Date: Nov. 15, 2018

(65) Prior Publication Data

US 2019/0325823 A1 Oct. 24, 2019

(30) Foreign Application Priority Data

May 12, 2017 (CN) ..... 2017 1 0336157

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2300/0439* (2013.01); *G09G 2300/0809* (2013.01)

(58) Field of Classification Search
CPC ..... G09G 2300/0804; G09G 3/3233; G09G 2300/0426
See application file for complete search history.

(56) References Cited

U.S. PATENT DOCUMENTS

2006/0114193 A1* 6/2006 Kwak ..... G09G 3/3233 345/76
2009/0219232 A1* 9/2009 Choi ..... G09G 3/3233 345/76

(Continued)

FOREIGN PATENT DOCUMENTS

CN 102194407 A 9/2011
CN 104112427 A 10/2014

(Continued)

OTHER PUBLICATIONS

International Seach Report and Written Opinion dated Mar. 8, 2018.

*Primary Examiner* — Chun-Nan Lin
(74) *Attorney, Agent, or Firm* — Dilworth & Barrese, LLP.; Michael J. Musella, Esq.

(57) ABSTRACT

A pixel circuit, a driving method thereof, and a display panel are provided. The pixel circuit includes a switching circuit, a shared circuit, a first sub-pixel circuit and a second sub-pixel circuit. The switching circuit includes a control terminal, a first terminal and a second terminal. The shared circuit includes a control terminal, a first terminal and a second terminal, the first terminal of the shared circuit is electrically connected to the second terminal of the switching circuit, both the first terminal of the shared circuit and the control terminal of the shared circuit are electrically connected to the first sub-pixel circuit and also electrically (Continued)

connected to the second sub-pixel circuit, and the shared circuit is configured to compensate for the first sub-pixel circuit and the second sub-pixel circuit.

13 Claims, 7 Drawing Sheets

(56) References Cited

U.S. PATENT DOCUMENTS

| | | | | |
|---|---|---|---|---|
| 2011/0221789 | A1 | 9/2011 | Ota | |
| 2015/0364085 | A1* | 12/2015 | Kanda | G09G 3/3233 345/214 |
| 2016/0155385 | A1* | 6/2016 | Yang | G09G 3/3233 345/174 |
| 2016/0204165 | A1 | 7/2016 | Yang | |
| 2017/0221419 | A1 | 8/2017 | Xiang et al. | |
| 2017/0229056 | A1 | 8/2017 | Li et al. | |

FOREIGN PATENT DOCUMENTS

| | | | |
|---|---|---|---|
| CN | 105528997 | A | 4/2016 |
| CN | 106531084 | A | 3/2017 |
| KR | 20060056791 | A | 5/2006 |

* cited by examiner

PIXEL CIRCUIT HAVING A SWITCHING CIRCUIT, A SHARED CIRCUIT, A FIRST SUB-PIXEL CIRCUIT AND A SECOND SUB-PIXEL CIRCUIT AND DRIVING METHOD THEREOF, DISPLAY PANEL

The application claims priority to the Chinese patent application No. 201710336157.5, filed on May 12, 2017, the entire disclosure of which is incorporated herein by reference as part of the present application.

TECHNICAL FIELD

Embodiments of the present disclosure relate to a pixel circuit, a driving method thereof, and a display panel.

BACKGROUND

Organic light emitting diode (OLED) display panels have gradually attracted widespread attention due to advantages such as wide viewing angle, high contrast ratio, fast response speed, both higher luminous brightness and lower driving voltage than those of inorganic light emitting display devices, and so on. Due to the above characteristics, organic light emitting diode (OLED) display panels can be applied to devices having a display function such as mobile phones, displayers, notebook computers, digital cameras, instruments, and so on.

In addition, for example, silicon-based OLED display screens may be used in virtual reality (VR) or augment reality (AR) display platforms. For example, in silicon-based OLED display screens, driving circuits may be manufactured on a silicon substrate by using a CMOS manufacturing process to integrate the driving function and the display function and meet the requirements of ultrahigh PPIdisplay.

SUMMARY

An embodiment of the present disclosure provides a pixel circuit, comprising: a switching circuit, a shared circuit, a first sub-pixel circuit and a second sub-pixel circuit. The switching circuit comprises a control terminal, a first terminal and a second terminal, the shared circuit comprises a control terminal, a first terminal and a second terminal, the first terminal of the shared circuit is electrically connected to the second terminal of the switching circuit, both the second terminal of the shared circuit and the control terminal of the shared circuit are electrically connected to the first sub-pixel circuit and also electrically connected to the second sub-pixel circuit, and the shared circuit is configured to compensate for the first sub-pixel circuit and the second sub-pixel circuit.

For example, in the pixel circuit provided by one example of the above embodiment, the shared circuit comprises a shared transistor, the shared transistor comprises a gate electrode, a first electrode and a second electrode, the first electrode of the shared transistor serves as the first terminal of the shared circuit, the second electrode of the shared transistor serves as the second terminal of the shared circuit, and the gate electrode of the shared transistor serves as the control terminal of the shared circuit.

For example, in the pixel circuit provided by one example of the above embodiment, the first sub-pixel circuit comprises a first driving transistor, a first light emitting device and a first node, the first driving transistor comprises a gate electrode electrically connected to the first node, and the first light emitting device is driven to emit light by an electric current flowing through the first driving transistor; the second sub-pixel circuit comprises a second driving transistor, a second light emitting device and a second node, the second driving transistor comprises a gate electrode electrically connected to the second node, and the second light emitting device is driven to emit light by an electric current flowing through the second driving transistor; both the gate electrode of the shared transistor and the second electrode of the shared transistor are electrically connected to the first node and the second node; and a threshold voltage of the first driving transistor and a threshold voltage of the second driving transistor are substantially equal to a threshold voltage of the shared transistor.

For example, in the pixel circuit provided by one example of the above embodiment, the first sub-pixel circuit further comprises a first sub-pixel switching transistor, the first sub-pixel switching transistor comprises a gate electrode, a first electrode and a second electrode, and the first electrode of the first sub-pixel switching transistor and the second electrode of the first sub-pixel switching transistor are electrically connected to the second electrode of the shared transistor and the first node, respectively.

For example, the pixel circuit provided by one example of the above embodiment further comprises a third sub-pixel circuit, the third sub-pixel circuit comprises a third driving transistor, a third light emitting device and a third node, the third driving transistor comprises a gate electrode electrically connected to the third node, and the third light emitting device is driven to emit light by an electric current flowing through the third driving transistor; both the gate electrode of the shared transistor and the second electrode of the shared transistor are electrically connected to the third node; and a threshold voltage of the third driving transistor is substantially equal to the threshold voltage of the shared transistor.

For example, in the pixel circuit provided by one example of the above embodiment, the first sub-pixel circuit further comprises a first sub-pixel switching transistor, the first sub-pixel switching transistor comprises a gate electrode, a first electrode and a second electrode, and the first electrode of the first sub-pixel switching transistor and the second electrode of the first sub-pixel switching transistor are electrically connected to the second electrode of the shared transistor and the first node, respectively; and the second sub-pixel circuit further comprises a second sub-pixel switching transistor, the second sub-pixel switching transistor comprises a gate electrode, a first electrode and a second electrode, and the first electrode of the second sub-pixel switching transistor and the second electrode of the second sub-pixel switching transistor are electrically connected to the second electrode of the shared transistor and the second node, respectively.

For example, the pixel circuit provided by one example of the above embodiment further comprises a reset circuit, the reset circuit comprises a control terminal, a first terminal and a second terminal, the first terminal of the reset circuit is capable of receiving a reset voltage, and the second terminal of the reset circuit is electrically connected to the first node and the second node, respectively.

For example, the pixel circuit provided by one example of the above embodiment further comprises a reset circuit, the reset circuit comprises a control terminal, a first terminal and a second terminal, the first terminal of the reset circuit is configured to receive a reset voltage, and the second terminal of the reset circuit is electrically connected to the first node through the first sub-pixel switching transistor and is further electrically connected to the second node.

For example, in the pixel circuit provided by one example of the above embodiment, the first sub-pixel circuit further comprises a first light emission control circuit, the first light emission control circuit comprises a control terminal, a first terminal and a second terminal, and the first terminal of the first light emission control circuit and the second terminal of the first light emission control circuit are respectively electrically connected to the first driving transistor and the first light emitting device, configured to turn on or turn off an electric current flowing through the first light emitting device; and the second sub-pixel circuit further comprises a second light emission control circuit, the second light emission control circuit comprises a control terminal, a second terminal and a second terminal, and the first terminal of the second light emission control circuit and the second terminal of the second light emission control circuit are respectively electrically connected to the second driving transistor and the second light emitting device, configured to turn on or turn off an electric current flowing through the second light emitting device.

For example, in the pixel circuit provided by one example of the above embodiment, the first sub-pixel circuit further comprises a first storage capacitor, and one terminal of the first storage capacitor is electrically connected to the first node for storing a voltage of the first node; and the second sub-pixel circuit further comprises a second storage capacitor, and one terminal of the second storage capacitor is electrically connected to the second node for storing a voltage of the second node.

For example, in the pixel circuit provided by one example of the above embodiment, the first light emitting device and the second light emitting device emit light of different colors.

For example, in the pixel circuit provided by one example of the above embodiment, the switching circuit comprises a switching circuit transistor, a first electrode of the switching circuit transistor serves as the first terminal of the switching circuit, a second electrode of the switching circuit transistor serves as the second terminal of the switching circuit, and a gate electrode of the switching circuit transistor serves as the control terminal of the switching circuit.

Another embodiment of the present disclosure provides a display panel, comprising any one of the above pixel circuits.

Another embodiment of the present disclosure provides a display panel, comprising a plurality of pixel units, in which each pixel unit comprises at least two sub-pixels, each pixel unit comprises any one of the above pixel circuits, and the at least two sub-pixels of the pixel unit correspond to the first sub-pixel circuit and the second sub-pixel circuit of the pixel circuit; or two adjacent pixel units share any one of the above pixel circuits, one sub-pixel of one pixel unit corresponds to the first sub-pixel circuit of the pixel circuit, and one sub-pixel of another pixel unit corresponds to the second sub-pixel circuit of the pixel circuit.

Another embodiment of the present disclosure provides a driving method of any one of the above pixel circuits, comprising: turning on the switching circuit and the shared circuit to compensate and drive the first sub-pixel circuit and the second sub-pixel circuit.

Another embodiment of the present disclosure provides a driving method of any one of the above pixel circuits, comprising: turning on the switching circuit and the shared transistor, and respectively charging the first node and the second node using received data voltages; and respectively controlling the first driving transistor and the second driving transistor through a voltage of the first node and a voltage of the second node, to respectively drive the first light emitting device and the second light emitting device to emit light.

For example, in the driving method provided by one example of the above embodiment, upon the switching circuit and the shared transistor being turned on, the first node and the second node are sequentially charged by using same or different received data voltages, respectively.

BRIEF DESCRIPTION OF THE DRAWINGS

In order to clearly illustrate the technical solution of the embodiments of the disclosure, the drawings of the embodiments will be briefly described in the following. It is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
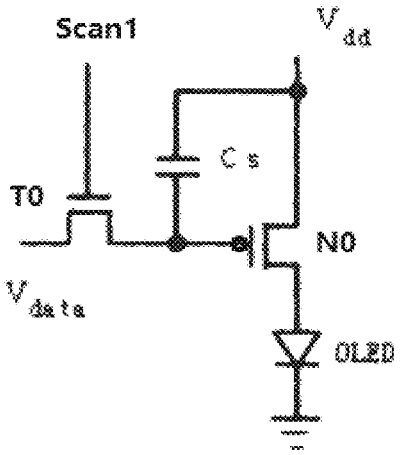
FIG. 1A is a schematic diagram of a 2T1C pixel circuit.
Figure 1B:
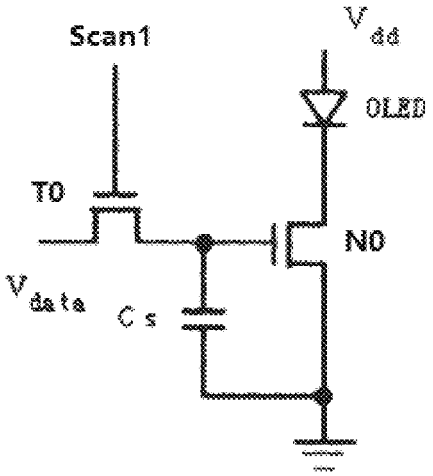
FIG. 1B is a schematic diagram of another 2T1C pixel circuit.

A basic pixel circuit used for an AMOLED display panel is generally a 2T1C pixel circuit, that is, two thin film transistors (TFTs) and one storage capacitor Cs are used to realize the basic function of driving an OLED to emit light. FIG. 1A and FIG. 1B are schematic diagrams respectively illustrating two types of 2T1C pixel circuits.

As illustrated in FIG. 1A, a 2T1C pixel circuit comprises a switching transistor T0, a driving transistor N0 and a storage capacitor Cs. For example, a gate electrode of the switching transistor T0 is connected to a gate line (scanning line) to receive a scanning signal (Scan1), a source electrode of the switching transistor T0 is connected to a data line to receive a data signal (Vdata), and a drain electrode of the switching transistor T0 is connected to a gate electrode of the driving transistor NO. A source electrode of the driving transistor N0 is connected to a first power supply terminal (Vdd, high voltage terminal) and a drain electrode of the driving transistor N0 is connected to an anode of the OLED. One terminal of the storage capacitor Cs is connected to both the drain electrode of the switching transistor T0 and the gate electrode of the driving transistor N0, and the other terminal of the storage capacitor Cs is connected to both the source electrode of the driving transistor N0 and the first power supply terminal. A cathode of the OLED is connected to a second power supply terminal (Vss, low voltage terminal), such as ground. The driving mode of the 2T1C pixel circuit is that the brightness and darkness (gray level) of the pixel is controlled by the two TFTs and the storage capacitor Cs. When the scanning signal Scan1 is applied through the gate line to turn on the switching transistor T0, the data voltage (Vdata) input by a data driving circuit through the data line charges the storage capacitor Cs through the switching transistor T0, thereby storing the data voltage in the storage capacitor Cs. The stored data voltage controls the conduction level of the driving transistor N0, thereby controlling the electric current flowing through the driving transistor to drive the OLED to emit light, that is, the electric current determines the gray level of the light emitted by the pixel. In the 2T1C pixel circuit illustrated in FIG. 1A, the switching transistor T0 is an N-type transistor and the driving transistor is a P-type transistor.

As illustrated in FIG. 1B, another 2T1C pixel circuit also comprises a switching transistor T0, a driving transistor N0 and a storage capacitor Cs, but the connection mode thereof is slightly changed, and the driving transistor N0 is an N-type transistor. More specifically, the difference of the pixel circuit in FIG. 1B compared with that in FIG. 1A comprises that the anode of the OLED is connected to the first power supply terminal (Vdd, high voltage terminal), the cathode of the OLED is connected to the drain electrode of the driving transistor N0, and the source electrode of the driving transistor N0 is connected to the second power supply terminal (Vss, low voltage terminal), such as ground. One terminal of the storage capacitor Cs is connected to both the drain electrode of the switching transistor T0 and the gate electrode of the driving transistor N0, and the other terminal of the storage capacitor Cs is connected to both the source electrode of the driving transistor N0 and the second power supply terminal. The operation mode of the 2T1C pixel circuit is basically the same as the pixel circuit illustrated in FIG. 1A, and will not be repeated here.

In addition, for the pixel circuits illustrated in FIG. 1A and FIG. 1B, the switching transistor T0 is not limited to an N-type transistor, but may be a P-type transistor as well, thus the polarity of the scanning signal (Scan1) which controls the switching transistor T0 to be turned on or turned off is changed accordingly.

An OLED display panel generally comprises a plurality of pixel units arranged in an array, and for example, each of the pixel units may adopt the above pixel circuit. However, in an organic light emitting diode (OLED) display panel, there is an IR drop phenomenon caused by a voltage division of the self-resistance of a wire in the display panel, that is, when an electric current flows through the wire in the display panel, there is a certain voltage drop along the wire according to the Ohm's law. Therefore, the pixel units located at different positions are affected by the IR drop to different extents, which causes the display panel to display nonuniformly. Therefore, it is necessary to compensate for the IR drop in the OLED display panel. In addition, in the OLED display panel, the threshold voltage of the driving transistor in each pixel unit may be different due to the manufacturing process, and the threshold voltage of the driving transistor may also drift due to, for example, effects of a temperature change and the operation period. So the difference between the threshold voltages of the driving transistors may also cause the display panel to display nonuniformly. Therefore, it also leads to the need to compensate for the threshold voltage.

Therefore, other pixel circuits having compensation functions based on the basic 2T1C pixel circuit are provided in the industry. The compensation function may be achieved through the way of voltage compensation, electric current compensation, or composite compensation. The pixel circuit having a compensation function may be, for example, 4T1C, 4T2C, or the like, which is not described in detail here. For these pixel circuits having compensation functions, the circuit portion for achieving the compensation function is disposed within one sub-pixel, which is disadvantageous in raising the display resolution, and the power consumption is large.

At least an embodiment of the present disclosure provides a pixel circuit, a driving method thereof, and a display panel. The pixel circuit has a compensation function, and is capable of improving the display uniformity of the display panel, reducing the number of data lines of the display panel, and reducing the occupied area of pixel units and the space between pixel units, thereby being helpful to achieve higher image quality and higher pixel density.

At least an embodiment of the present disclosure provides a pixel circuit. The pixel circuit comprises a switching circuit, a shared circuit, a first sub-pixel circuit and a second sub-pixel circuit; the switching circuit comprises a control terminal, a first terminal and a second terminal; and the shared circuit comprises a control terminal, a first terminal and a second terminal, the first terminal of the shared circuit is electrically connected to the second terminal of the switching circuit, both the second terminal of the shared circuit and the control terminal of the shared circuit are electrically connected to the first sub-pixel circuit and also electrically connected to the second sub-pixel circuit, and the shared circuit is configured to compensate for the first sub-pixel circuit and the second sub-pixel circuit.

For example, in the pixel circuit provided by one example of the above embodiment, the shared circuit comprises a shared transistor, the first sub-pixel circuit comprises a first driving transistor, a first light emitting device and a first node, the first driving transistor comprises a gate electrode electrically connected to the first node, and the first light emitting device is driven to emit light by an electric current flowing through the first driving transistor; the second sub-pixel circuit comprises a second driving transistor, a second light emitting device and a second node, the second driving transistor comprises a gate electrode electrically connected to the second node, and the second light emitting device is driven to emit light by an electric current flowing through the second driving transistor; both the gate electrode of the shared transistor and the second electrode of the shared transistor are electrically connected to the first node and the second node, respectively; and a threshold voltage of the first driving transistor and a threshold voltage of the second driving transistor are substantially equal to a threshold voltage of the shared transistor.

Another embodiment of the present disclosure provides a display panel, and the display panel comprises the pixel circuit of the above embodiment.

Another embodiment of the present disclosure provides a driving method of the pixel circuit of the above embodiment, and the method comprises: turning on the switching circuit and the shared circuit to compensate and drive the first sub-pixel circuit and the second sub-pixel circuit.

For example, the driving method of the pixel circuit of the above embodiment comprises: turning on the switching circuit and the shared transistor, and respectively charging the first node and the second node using received data voltages; and respectively controlling the first driving transistor and the second driving transistor through a voltage of the first node and a voltage of the second node, to respectively drive the first light emitting device and the second light emitting device to emit light.

The pixel circuit, the driving method thereof, and the display panel according to the embodiments of the present disclosure are described below with reference to several embodiments.

Figure 2:
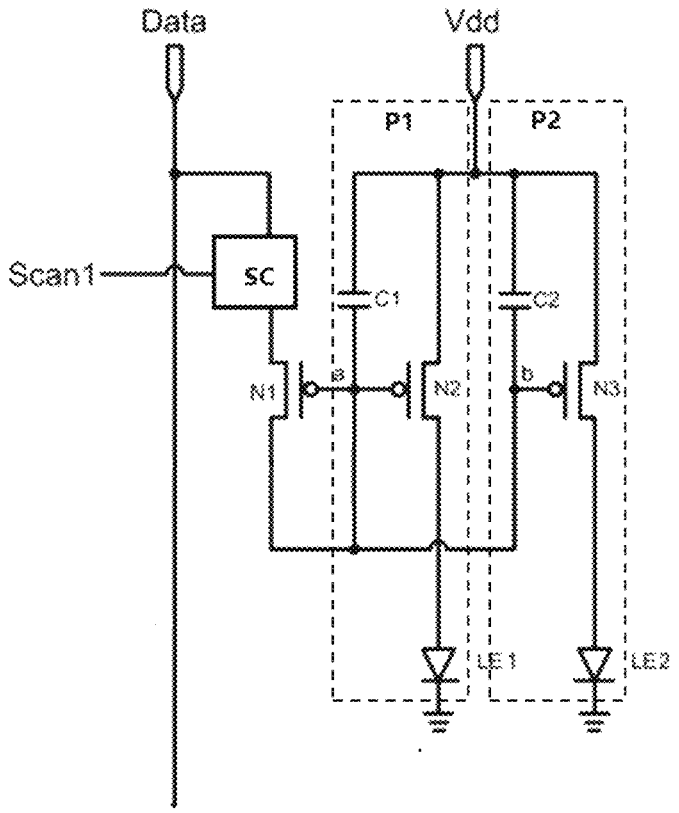
FIG. 2 is a schematic diagram of a pixel circuit provided by an embodiment of the present disclosure.

An embodiment of the present disclosure provides a pixel circuit which can be applied to, for example, a display panel such as a silicon-based OLED display panel or the like. As illustrated in FIG. 2, the pixel circuit comprises a switching circuit SC, a shared circuit, a first sub-pixel circuit P1 and a second sub-pixel circuit P2.

The switching circuit SC comprises a control terminal, a first terminal, and a second terminal, and for example, the first terminal and the second terminal respectively serve as an input terminal of the switching circuit and an output terminal of the switching circuit, which is taken as an example in the following description. The input terminal of the switching circuit is connected to a data driver (not illustrated) through a data line (Data) to receive a data voltage, which is used for enabling the first sub-pixel circuit P1 or the second sub-pixel circuit P2 to emit light at a corresponding gray level at work. The control terminal of the switching circuit SC is connected to a first scanning line (gate line) Scan1 to receive a corresponding scanning signal and to be turned on or turned off according to the scanning signal.

The shared circuit comprises a control terminal, a first terminal, and a second terminal. The first terminal of the shared circuit is electrically connected to the second terminal of the switching circuit, and both the second terminal of the shared circuit and the control terminal of the shared circuit are electrically connected to the first sub-pixel circuit and also electrically connected to the second sub-pixel circuit. For example, the shared circuit comprises a shared transistor. The shared transistor comprises a gate electrode, a first electrode, and a second electrode. The first electrode of the shared transistor serves as the first terminal of the shared circuit, the second electrode of the shared transistor serves as the second terminal of the shared circuit, and the gate electrode of the shared transistor serves as the control terminal of the shared circuit. As illustrated in the figure, a shared transistor N1 is one example of the shared circuit. Of course, the shared circuit may also be implemented in other ways, which is not limited in the embodiment of the present disclosure.

The shared transistor N1 comprises a gate electrode, a first electrode, and a second electrode, and for example, the first electrode and the second electrode respectively serve as an input electrode and an output electrode, which is taken as an example in the following description. The input electrode of the shared transistor is electrically connected to the output terminal of the switching circuit SC, so that the corresponding data voltage can be received when the switching circuit SC is turned on.

The first sub-pixel circuit P1 and the second sub-pixel circuit P2 are arranged, for example, side by side, as indicated by the dotted lines in the figure. In at least an embodiment, the first sub-pixel circuit P1 comprises a first driving transistor N2, a first light emitting device LE1, and a first node a. The first driving transistor N2 comprises a gate electrode, a first electrode, and a second electrode, and the first electrode and the second electrode here respectively serve as, for example, an input electrode and an output electrode, which is taken as an example in the following description. The gate electrode of the first driving transistor N2 is electrically connected to the first node a, and the first light emitting device LE1 is driven to emit light by the electric current flowing through the first driving transistor N2. Similarly, the second sub-pixel circuit P2 comprises a second driving transistor N3, a second light emitting device LE2, and a second node b. The second driving transistor N3 comprises a gate electrode, a first electrode, and a second electrode, and the first electrode and the second electrode here respectively serve as, for example, an input electrode and an output electrode, which is taken as an example in the following description. The gate electrode of the second driving transistor N3 is electrically connected to the second node b, and the second light emitting device LE2 is driven to emit light by the electric current flowing through the second driving transistor N3. The first light emitting device LE1 and the second light emitting device LE2 here may be light emitting diodes, such as organic light emitting diodes (OLEDs), inorganic light emitting diodes, or the like. Each of the first light emitting device LE1 and the second light emitting device LE2 comprises two terminals, i.e., a first terminal and a second terminal, which are, for example, an anode and a cathode respectively. The first light emitting device LE1 and the second light emitting device LE2 are electrically connected to other components, power supply terminals and the like in the circuit through the two terminals, respectively. The gate electrode and the output electrode of the shared transistor N1 are both electrically connected to the first node a and the second node b, respectively.

Here, the threshold voltage (Vth2) of the first driving transistor N2 and the threshold voltage (Vth3) of the second driving transistor N3 are substantially equal to the threshold voltage (Vth1) of the shared transistor N1, that is, $Vth1 \approx Vth2 \approx Vth3$, or $Vth1 = Vth2 = Vth3$. In the present disclosure, "substantially equal" comprises that the two are equal or substantially equal to each other; and for two numerical values, in case that the difference between the two values is less than 20% of the reference value which is selected to be the larger one, it can be considered that the two values are substantially equal to each other. Preferably, the difference is less than 10%.

In the embodiment as illustrated in FIG. 2, the first sub-pixel circuit P1 further comprises a first storage capacitor C1. A first terminal of the first storage capacitor C1 is electrically connected to the first node a, and accordingly is also electrically connected to other components which are connected to the first node a. A second terminal of the first storage capacitor C1 is electrically connected to both the input electrode of the first driving transistor N2 and a first power supply terminal Vdd for storing the voltage of the first node a. The input electrode of the first driving transistor N2 is also electrically connected to the first power supply terminal Vdd, and the output electrode of the first driving transistor N2 is connected to the anode of the first light emitting device LE1. The cathode of the first light emitting device LE1 is connected to a second power supply terminal (Vss, low voltage terminal), such as ground.

Similarly, the second sub-pixel circuit P2 further comprises a second storage capacitor C2. A first terminal of the second storage capacitor C2 is electrically connected to the second node b, and accordingly is also electrically connected to other components which are connected to the second node b. A second terminal of the second storage capacitor C2 is electrically connected to both the input electrode of the second driving transistor N3 and the first power supply terminal Vdd for storing the voltage of the second node b. The input electrode of the second driving transistor N3 is also connected to the first power supply terminal Vdd, and the output electrode of the second driving transistor N3 is connected to the anode of the second light emitting device LE2. The cathode of the second light emitting device LE2 is connected to the second power supply terminal (Vss, low voltage terminal), such as ground.

In this embodiment and other embodiments below, the first light emitting device LE1 and the second light emitting device LE2 may emit light of same color, such as red light, green light, or blue light, and may also emit light of different colors, and for example, one emits red light while the other emits green light, blue light or the like. When the first light emitting device LE1 and the second light emitting device LE2 emit light of same color, the first sub-pixel circuit P1 and the second sub-pixel circuit P2 may belong to a same pixel unit or different pixel units on the display panel. In comparison, the former has a lower resolution ratio. Moreover, the OLED which serves as the light emitting device may have various structures, such as top emission, bottom emission, double emission, or the like.

In the example as illustrated in FIG. 2, the above transistors are all P-type transistors, as a result, in the first sub-pixel circuit P1 and the second sub-pixel circuit P2, the connected relation of the driving transistors, the storage capacitors, the first power supply terminal (Vdd) and the second power supply terminal (Vss) is the same as that in FIG. 1A. However, those skilled in the art can understand that the above transistors may also adopt N-type transistors. For example, in another example of the present embodiment, in the first sub-pixel circuit P1 and the second sub-pixel circuit P2, the connected relationship of the driving transistors, the storage capacitors, the first power supply terminal (Vdd) and the second power supply terminal (Vss) is the same as that in FIG. 1B. Moreover, as needed, the first sub-pixel circuit P1 and the second sub-pixel circuit P2 may also comprise other components, such as additional transistors or capacitors, to achieve functions such as monitoring/detection, reset, and the like. For example, in order to achieve the reset for the sub-pixel circuits, a reset circuit electrically connected to the first node a and the second node b may be added in the circuit as illustrated in FIG. 2, and the reset circuit may be turned on to apply an initial voltage to the first node a and the second node b under the control of a reset signal. This embodiment and the following embodiments of the present disclosure are not limited thereto, and the following description takes P-type transistors as an example.

Figure 3:
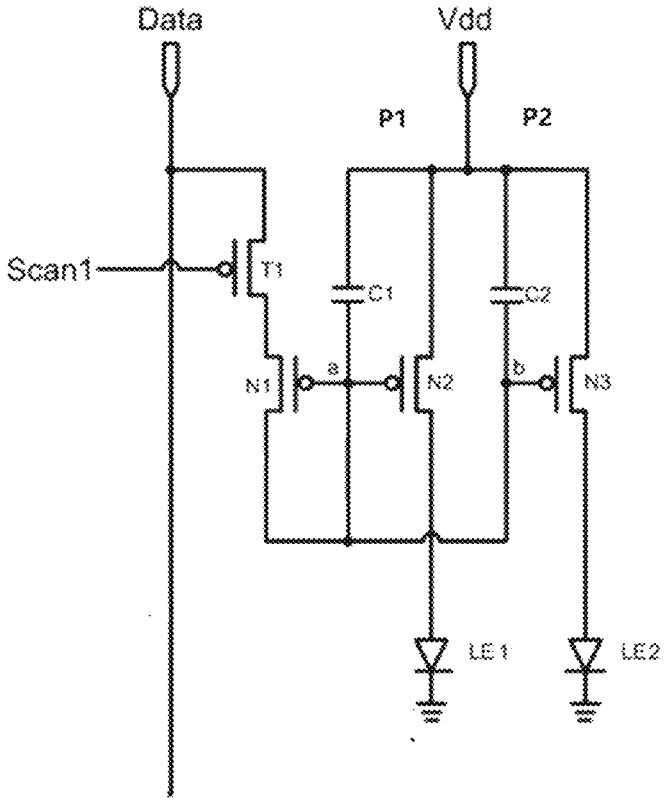
FIG. 3 is a schematic diagram of a pixel circuit provided by another example of the embodiment of the present disclosure.

In one example of the embodiment, the switching circuit SC comprises a switching circuit transistor T1. The switching circuit transistor T1 may be an N-type transistor or a P-type transistor, and the following description takes a P-type transistor as an example. As illustrated in FIG. 3, the switching circuit transistor T1 of the switching circuit SC comprises a gate electrode, a first electrode, and a second electrode, and for example, the first electrode and the second electrode are a source electrode and a drain electrode respectively, which is taken as an example in the following description. The gate electrode is connected to the first scanning line Scan1, the source electrode serves as the input terminal and is connected to the data driver through the data line (Data) for receiving the data voltage, and the drain electrode serves as the output terminal and is connected to the input electrode of the shared transistor N1. Therefore, when the switching circuit transistor T1 is turned on under the control of the signal applied from the first scanning line Scan1, the data voltage can be transmitted to the input electrode of the shared transistor N1.

In order to make the threshold voltage (Vth2) of the first driving transistor N2 and the threshold voltage (Vth3) of the second driving transistor N3 substantially equal to the threshold voltage (Vth1) of the shared transistor N1, for example, the shared transistor N1, the first driving transistor N2 and the second driving transistor N3 may be disposed next to each other, thus for them, the fluctuations of the manufacturing process parameters are small, and the difference in physical characteristics and electrical characteristics can be kept small. For example, when these transistors are polysilicon thin film transistors (e.g., low-temperature polysilicon TFTs), the active layers of these transistors may be different portions of a same polysilicon film, thereby having substantially the same thickness, conductivity, and the like. As a result, the threshold voltages of these transistors can be substantially the same. For another example, the shared transistor N1 may be disposed symmetrically with the first driving transistor N2 or the second driving transistor N3, so the threshold voltages of the two may be equal in the case of mirror circuit arrangement. In particular, for silicon-based OLEDs, it is easier to make the threshold voltages Vth1 and Vth2 substantially equal to each other under the premise of a silicon-based process and high PPI display.

In this embodiment, two adjacently disposed sub-pixels share the compensation circuit portion, that is, the compensation circuit portions of the two are combined, and also the two adjacently disposed sub-pixels can be controlled through only one data line. Therefore, in the display panel adopting the pixel circuit, compared with a common pixel circuit having a compensation function, the number of data lines can be reduced, and the occupied area of pixel units and the space between pixel units can be reduced, thereby being helpful to achieve higher image quality and higher pixel density.

Figure 4:
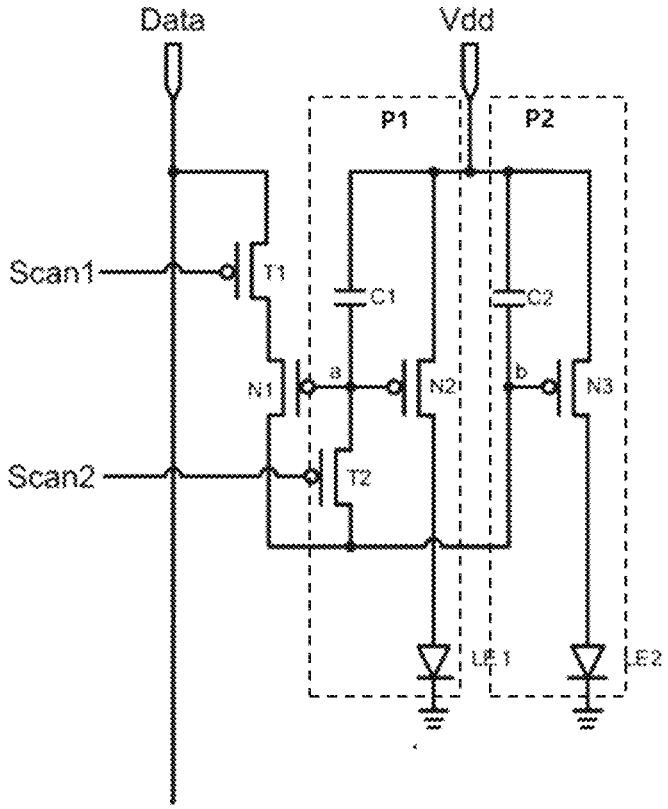
FIG. 4 is a schematic diagram of a pixel circuit provided by still another embodiment of the present disclosure.

As illustrated in FIG. 4, another embodiment of the present disclosure further provides a pixel circuit. The pixel circuit may be based on the embodiment as illustrated in FIG. 2. In contrast, the pixel circuit also comprises a switching circuit SC, a shared transistor N1, a first sub-pixel circuit P1 and a second sub-pixel circuit P2.

Furthermore, in addition to the first driving transistor N2 and the first storage capacitor C1, the first sub-pixel circuit P1 further comprises a first sub-pixel switching transistor T2, which comprises a gate electrode, a first electrode, and a second electrode. The first electrode and the second electrode of the first sub-pixel switching transistor T2 are electrically connected to the output electrode of the shared transistor N1 and the first node a, respectively, and the gate electrode thereof is connected to a second scanning line Scan2, thereby being turned on or turned off under the control of a second scanning signal applied from the second scanning line Scan2. When the first sub-pixel switching transistor T2 is turned on, the first node a may be charged/discharged through the first sub-pixel switching transistor T2.

As illustrated in FIG. 4, the first sub-pixel switching transistor T2 is a P-type transistor, but the embodiment of the present disclosure is not limited thereto. By providing the first sub-pixel switching transistor T2, the first sub-pixel circuit P1 and the second sub-pixel circuit P2 can be respectively (e.g., time-divisionally) controlled and driven to perform programming, light emission, and the like.

In this embodiment, the switching circuit SC may comprise a switching circuit transistor T1 and the like as in the example illustrated in FIG. 3.

In another example of the present embodiment, the second sub-pixel circuit P2 may also comprise a second sub-pixel switching transistor (not illustrated, or referring to FIG. 8) corresponding to the first sub-pixel switching transistor T2. A first electrode and a second electrode of the second sub-pixel switching transistor are electrically connected to the output electrode of the shared transistor N1 and the second node b, respectively, and may be controlled through another scanning line different from the second scanning line Scan2, thereby enabling the first sub-pixel circuit P1 and the second sub-pixel circuit P2 to be respectively controlled and driven.

Yet another embodiment of the present disclosure further provides a pixel circuit. The pixel circuit may be based on the embodiment illustrated in FIG. 2, FIG. 3, or FIG. 4, respectively. Compared to these embodiments, the pixel circuit also comprises a switching circuit SC, a shared transistor N1, a first sub-pixel circuit P1 and a second sub-pixel circuit P2.

Figure 5:
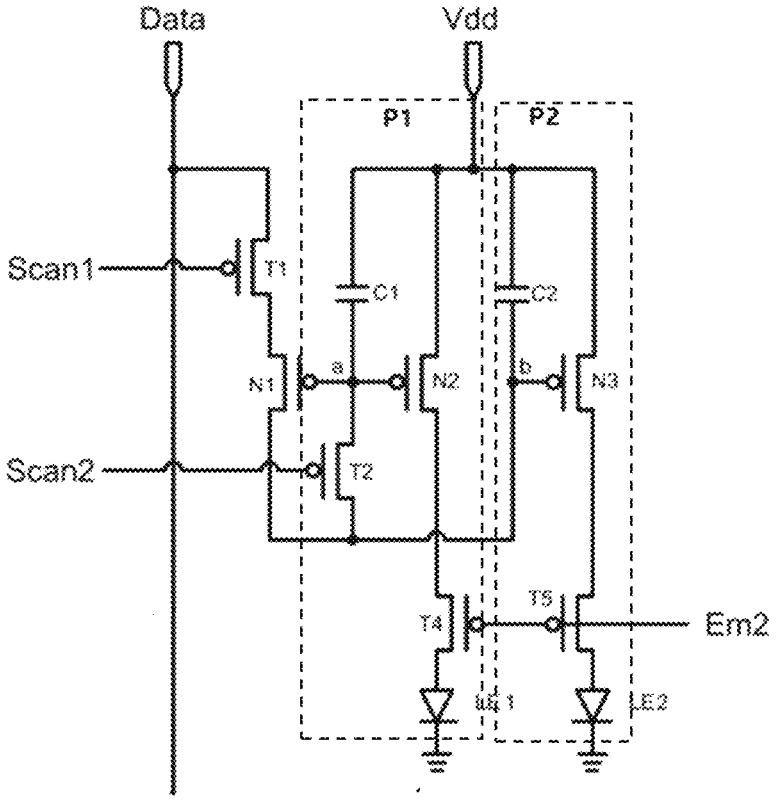
FIG. 5 is a schematic diagram of a pixel circuit provided by still another embodiment of the present disclosure.

For example, as illustrated in FIG. 5, compared with the embodiment illustrated in FIG. 4, in the pixel circuit of one example of this embodiment, in addition to the first driving transistor N2, the first storage capacitor C1 or the first sub-pixel switching transistor T2, the first sub-pixel circuit P1 further comprises a first light emission control circuit, and for example, the first light emission control circuit comprises a first light emission control transistor T4. The first light emission control circuit comprises a control terminal, a first terminal, and a second terminal. The first terminal and the second terminal of the first light emission control circuit are electrically connected to the second electrode of the first driving transistor N2 and the first terminal of the first light emitting device LE1. respectively, to turn on or turn off the electric current flowing through the first light emitting device LE1, thereby preventing the first light emitting device LE1 from emitting light due to the leakage current flowing through the first driving transistor N2 when the first light emitting device LE1 should not emit light, which can be used to increase the contrast ratio of the sub-pixel corresponding to the first sub-pixel circuit.

Similarly, in addition to the second driving transistor N3 and the second storage capacitor C2, the second sub-pixel circuit P2 further comprises a second light emission control circuit, and for example, the second light emission control circuit comprises a second light emission control transistor T5. The second light emission control circuit comprises a control terminal, a first terminal, and a second terminal. The first terminal and the second terminal of the second light emission control circuit are electrically connected to the second electrode of the second driving transistor N3 and the first terminal of the second light emitting device LE2, respectively, to turn on or turn off the electric current flowing through the second light emitting device LE2, thereby preventing the second light emitting device LE2 from emitting light due to the leakage current flowing through the second driving transistor N3 when the second light emitting device LE2 should not emit light, which can be used to increase the contrast ratio of the sub-pixel corresponding to the second sub-pixel circuit.

In the example illustrated in FIG. 5, the control terminals (gate electrodes) of the first light emission control transistor T4 and the second light emission control transistor T5 are connected to a same control signal terminal Em2, for example, through a same signal line. However, those skilled in the art may understand that the two transistors may also be connected to the control signal terminal Em2 through different signal lines, respectively, or be connected to different control signal terminals through different signal lines, respectively.

In the example illustrated in FIG. 5, both the first light emission control transistor T4 and the second light emission control transistor T5 are P-type transistors, and both of them may also be N-type transistors, which is not limited in the embodiment of the present disclosure.

In the example illustrated in FIG. 5, the first electrode and the second electrode of the first light emission control transistor T4 are electrically connected between the drain electrode of the first driving transistor N2 and the anode of the first light emitting device LE1, respectively. The first electrode and the second electrode of the second light emission control transistor T5 are electrically connected between the drain electrode of the second driving transistor N3 and the anode of the second light emitting device LE2, respectively. However, when the first sub-pixel circuit P1 and the second sub-pixel circuit P2 are disposed based on, for example, the 2T1C basic pixel circuit as illustrated in FIG. 1B, the first light emission control transistor may be disposed between the cathode of the first light emitting device and the drain electrode of the first driving transistor, and the second light emission control transistor may be disposed between the cathode of the second light emitting device and the drain electrode of the second driving transistor. Therefore, the position is not limited in the embodiment of the present disclosure as long as the first light emission control circuit can turn on or turn off the electric current flowing through the first light emitting device and the second light emission control circuit can turn on or turn off the electric current flowing through the second light emitting device.

For the embodiment in which the light emission control circuit is not provided, for example, the similar technical effect may be achieved by controlling whether the driving voltage Vdd is applied or not.

Another embodiment of the present disclosure provides a pixel circuit. The pixel circuit may be based on the embodiment illustrated in FIG. 2, FIG. 3, FIG. 4 or FIG. 5. Compared to these embodiments, the pixel circuit also comprises a switching circuit SC, a shared transistor N1, a first sub-pixel circuit P1 and a second sub-pixel circuit P2, and furthermore comprises a reset circuit, for example, which comprises a reset transistor T3.

Figure 6:
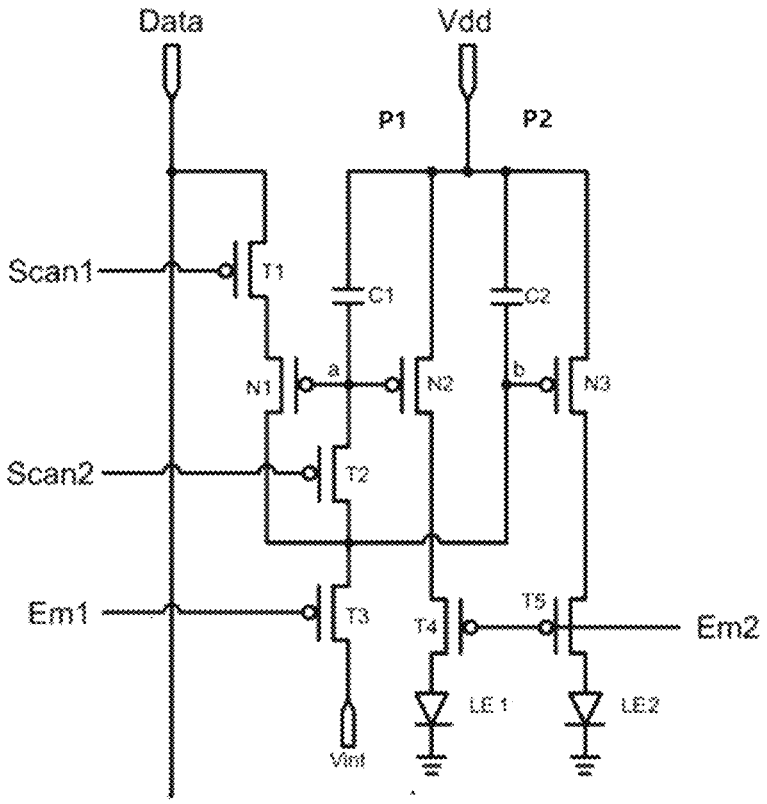
FIG. 6 is a schematic diagram of a pixel circuit provided by still another embodiment of the present disclosure.

The reset circuit comprises a control terminal, a first terminal, and a second terminal, and the first terminal and the second terminal respectively serve as, for example, an input terminal and an output terminal, which is taken as an example in the following description. The input terminal of the reset circuit is capable of receiving a reset voltage Vint. The control terminal of the reset circuit, such as the gate electrode of the reset transistor T3, is connected to a control signal terminal Em1 through a signal line. The output terminal of the reset circuit is electrically connected to the first node a of the first sub-pixel circuit P1 and the second node b of the second sub-pixel circuit P2, respectively. For another example, compared with the embodiment illustrated in FIG. 4 or FIG. 5, the output terminal of the reset circuit is electrically connected to the first node a through the first sub-pixel switching transistor T2 and is electrically connected to the second node b, directly. FIG. 6 is a schematic diagram of a pixel circuit added with the reset circuit based on the embodiment illustrated in FIG. 5.

Therefore, when the reset circuit is turned on, the reset voltage Vint may be applied to the first node a of the first sub-pixel circuit P1 and the second node b of the second sub-pixel circuit P2, so that the first node a (when there is a first sub-pixel switching transistor T2, it should be turned on at the same time) and the second node b are reset to an initial state, which is favorable for subsequent operations such as programming, light emission and the like, and can shorten the time of charging, programming and the like as compared with the embodiment without the reset circuit.

In the example illustrated in FIG. 6, the first sub-pixel circuit P1 and the second sub-pixel circuit P2 share the same reset circuit (reset transistor T3). However, those skilled in the art may understand that the first sub-pixel circuit P1 and the second sub-pixel circuit P2 may be respectively provided with a reset circuit to reset the first sub-pixel circuit P1 and the second sub-pixel circuit P2, respectively.

Another embodiment of the present disclosure provides a pixel circuit. The pixel circuit may be respectively based on the embodiment illustrated in FIG. 2, FIG. 3, FIG. 4, FIG. 5 or FIG. 6. Compared to these embodiments, in addition that the pixel circuit also comprises a switching circuit SC, a shared transistor N1, a first sub-pixel circuit P1 and a second sub-pixel circuit P2, or also comprises a reset circuit, the pixel circuit further comprises a third sub-pixel circuit P3.

Figure 7:
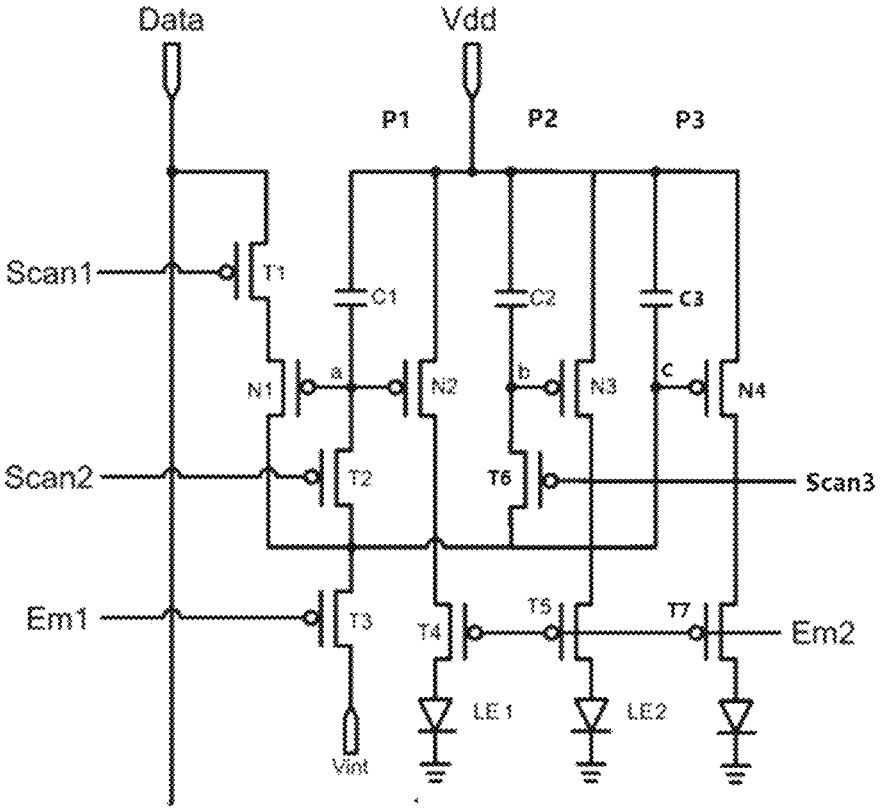
FIG. 7 is a schematic diagram of a pixel circuit provided by still another embodiment of the present disclosure.

As illustrated in FIG. 7, compared with the example illustrated in FIG. 6, the third sub-pixel circuit comprises a third driving transistor N4, a third light emitting device LE3, and a third node c. The third driving transistor N4 comprises a gate electrode, a first electrode, and a second electrode, and the first electrode and the second electrode here respectively serve as, for example, an input electrode and an output electrode, which is taken as an example in the following description. The gate electrode of the third driving transistor N4 is electrically connected to the third node c, and the third light emitting device LE3 is driven to emit light by the electric current flowing through the third driving transistor N4.

Accordingly, both the gate electrode of the shared transistor N1 and the output electrode of the shared transistor N1 are also electrically connected to the third node c. The threshold voltage (Vth4) of the third driving transistor is also substantially equal to the threshold voltage of the shared transistor N1, that is, Vth1≈Vth4, or Vth1=Vth4. Similarly, the threshold voltage (Vth4) of the third driving transistor can be made substantially equal to the threshold voltage of the shared transistor N1 by the method as described above.

In addition, the third sub-pixel circuit P3 further comprises a third storage capacitor C3. A first terminal of the third storage capacitor C3 is electrically connected to the third node c, and a second terminal of the third storage capacitor C3 is electrically connected to both the input electrode of the third driving transistor N4 and the first power supply terminal Vdd, to store the voltage of the third node c. The input electrode of the third driving transistor N4 is also connected to the first power supply terminal Vdd, and the output electrode thereof is connected to the anode of the third light emitting device LE3. The cathode of the third light emitting device LE3 is connected to the second power supply terminal (Vss, low voltage terminal), such as ground.

In one example of the present embodiment, the second sub-pixel circuit P2 may further comprise a second sub-pixel switching transistor T6 corresponding to the first sub-pixel switching transistor T2, which comprises a gate electrode, a first electrode, and a second electrode. The first electrode and the second electrode of the second sub-pixel switching transistor T6 are electrically connected between the output electrode of the shared transistor N1 and the second node b, respectively, and the gate electrode thereof can be controlled through a third scanning line Scan3 which is different from the second scanning line Scan2, thereby enabling the first sub-pixel circuit P1, the second sub-pixel circuit P2, and the third sub-pixel circuit P3 to be respectively controlled and driven. When the second sub-pixel switching transistor T6 is turned on, the second node b may be charged or discharged through the second sub-pixel switching transistor T6. In another example, the third sub-pixel circuit P3 may also comprise a corresponding third sub-pixel switching transistor (not illustrated), thereby enabling the first sub-pixel circuit P1, the second sub-pixel circuit P2, and the third sub-pixel circuit P3 can be respectively controlled and driven.

In another example of the present embodiment, the third sub-pixel circuit P3 may further comprise a third light emission control circuit in addition to the third driving transistor N4 and the third storage capacitor C3. For example, the third light emission control circuit comprises a third light emission control transistor T7. The third light emission control circuit comprises a control terminal, a first terminal, and a second terminal. The first terminal and the second terminal of the third light emission control circuit are electrically connected to the second electrode of the third driving transistor N4 and the first terminal of the third light emitting device LE3 to turn on or turn off the electric current flowing through the third light emitting device LE3, thereby preventing the third light emitting device LE3 from emitting light due to the leakage current flowing through the third driving transistor N4 when the third light emitting device LE3 should not emit light, which can be used to increase the contrast ratio of the sub-pixel corresponding to the third sub-pixel circuit. The control terminal (gate electrode) of the third light emission control transistor T7 and the control terminals (gate electrodes) of the first light emission control transistor T4 and the second light emission control transistor T5 may be controlled, for example, through a same signal line or different control lines.

In another example of the present embodiment, the pixel circuit further comprises a reset circuit. For example, the reset circuit comprises a reset transistor T3. Similarly, the reset circuit comprises a control terminal, a first terminal, and a second terminal, and the first terminal and the second terminal respectively serve as, for example, an input terminal and an output terminal. The output terminal of the reset circuit is electrically connected to the first node a of the first sub-pixel circuit P1, the second node b of the second sub-pixel circuit P2, and the third node c of the third sub-pixel circuit P3, respectively. Alternatively, an independent reset circuit may be provided to the third sub-pixel circuit P3.

In FIG. 7, the transistors described above are all illustrated as P-type transistors, but these transistors may also be N-type transistors, which is not limited in the embodiment of the present disclosure.

The third light emitting device LE3 may emit light of the same color as the first light emitting device LE1 and the second light emitting device LE2, or emit light of different colors from the first light emitting device LE1 and the second light emitting device LE2. For example, one of them emits red light, another one emits green light, and yet another one emits blue light, thus the three devices constitute one pixel unit, and are controlled and driven in a time-sharing way to implement the display of the pixel unit.

Another embodiment of the present disclosure provides a driving method of the pixel circuit of the above embodiment. The method at least comprises: turning on the switching circuit and the shared circuit to compensate and drive the first sub-pixel circuit and the second sub-pixel circuit.

More specifically, in one example, the shared circuit comprises a shared transistor, and accordingly, the driving method of the pixel circuit comprises: turning on the switching circuit and the shared transistor, and respectively charging the first node and the second node using the received data voltages; and respectively controlling the first driving transistor and the second driving transistor through the voltage of the first node and the voltage of the second node, to respectively drive the first light emitting device and the second light emitting device to emit light.

One specific example of the driving method is described below taking the pixel circuit of the embodiment illustrated in FIG. 6 as an example. However, those skilled in the art should understand that, with respect to the embodiments illustrated in FIGS. 2-5, the timing control of the corresponding driving method can be obtained through the corresponding changes, and the example of the present disclosure is not limited to the driving method of the specific embodiment.

Figure 8:
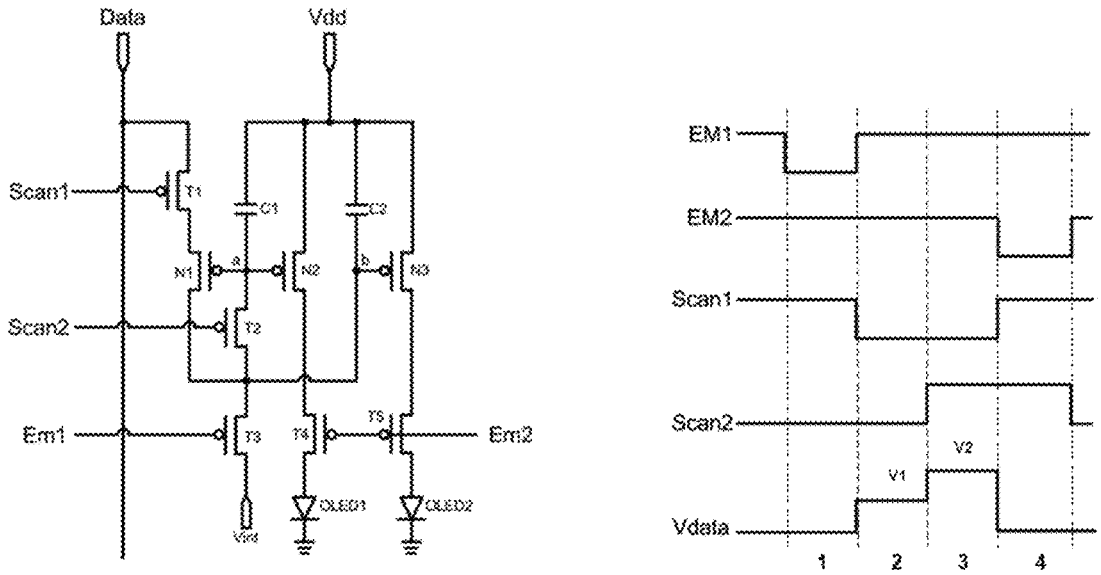
FIGS. 8-12 are timing diagrams of a driving method of a pixel circuit provided by another embodiment of the present disclosure.

The left side of FIG. 8 illustrates one specific example of the pixel circuit of the embodiment illustrated in FIG. 6, in which the first light emitting device LE1 and the second light emitting device LE2 respectively adopt a first organic light emitting diode OLED1 and a second organic light emitting diode OLED2. The right side of FIG. 8 illustrates the corresponding drive timing. In the figure, EM1, EM2, Scan1 and Scan2 all represent the control signals or the scanning signals applied to the corresponding control lines or scanning lines in the pixel circuit, and Vdata represents the data voltage applied to the data line.

The above driving method of the pixel circuit may comprises a reset phase, a first sub-pixel charge compensation phase, a second sub-pixel charge compensation phase, and a light emitting phase. The four phases of the above driving method is described step by step below with reference to FIGS. 9-12. The symbol "○" represents that the corresponding transistor is turned on, the symbol "x" represents that the corresponding transistor is turned off, and the state of the transistor without any one of the two symbols can be determined according to the corresponding signal or electrical level. Moreover, the direction of the arrow in the figure represents the direction of the electric current.

(1) The Reset Phase

Figure 9:
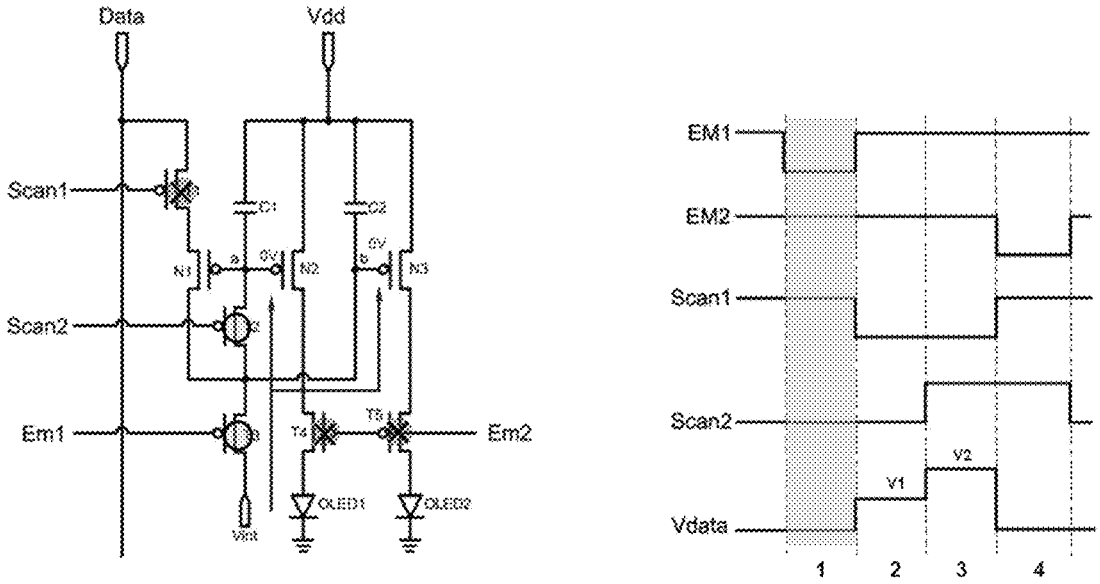

FIG. 9 illustrates the reset phase of the exemplary pixel circuit described above, that is, the phase 1 in the timing diagram. At this time, the signal EM1 is at a low level, the signal EM2 is at a high level, the signal Scan1 is at a high level, and the signal Scan2 is at a low level. So the reset transistor T3 is in a turning-on state, the first light emission control transistor T4 and the second light emission control transistor T5 are in turning-off states, the switching circuit transistor T1 is in a turning-off state, and the first sub-pixel switching transistor T2 is in a turning-on state. Therefore, the reset voltage Vint is input to the first node a and the second node b, and for example, the reset voltage Vint is a ground voltage or 0V (may also be other low level signals). The electric potentials of the first node a and the second node b are charged to Vint, so the corresponding first storage capacitor C1 and the second storage capacitor C2 are discharged accordingly, making the electric potentials of the first node a and the second node b be Vint.

In addition, the figure illustrates that the data signal Vdata is at a low level at this time, but it may also be at other level or be floated. Because the switching circuit transistor T1 is in the turning-off state, it has no effect on other parts of the pixel circuit.

(2) The First Sub-Pixel Charge Compensation Phase

Figure 10:
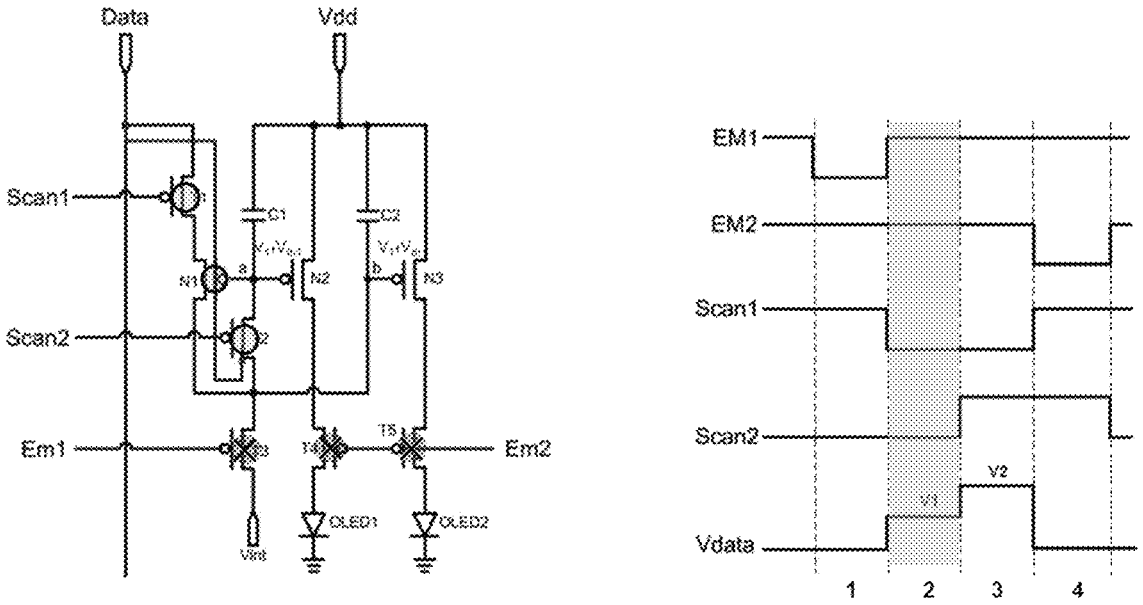

FIG. 10 illustrates the first sub-pixel charge compensation phase of the exemplary pixel circuit described above, that is, the phase 2 in the timing diagram. At this time, the signal EM1 is at a high level, the signal EM2 is at a high level, the signal Scan1 is at a low level, and the signal Scan2 is at a low level. So the reset transistor T3 is in a turning-off state, the first light emission control transistor T4 and the second light emission control transistor T5 are in turning-off states, the switching circuit transistor T1 is in a turning-on state, and the first sub-pixel switching transistor T2 is in a turning-on state. Furthermore, because the electric potentials of the first node a and the second node b are Vint (low level), the shared transistor N1, the first driving transistor N2, and the second driving transistor N3 are also in turning-on states at the beginning of the phase. However, the first light emission control transistor T4 and the second light emission control transistor T5 are in the turning-off states, so the first light emitting device LE1 and the second light emitting device LE2 do not emit light.

The figure illustrates that the data voltage Vdata is a first data voltage V1 (i.e., Vdata=V1) at this time. The first data voltage V1 is a gray level voltage for the first sub-pixel circuit P1. The first data voltage V1 charges the first node a and the second node b through the shared transistor N1 until the voltages of the first node a and the second node b are V1+Vth1, where Vth1 is the threshold voltage of the shared transistor N1. Because the shared transistor N1 is a P-type transistor, its threshold voltage Vth1 is usually negative. In this way, the first sub-pixel charge compensation phase is completed.

(3) The Second Sub-Pixel Charge Compensation Phase

Figure 11:
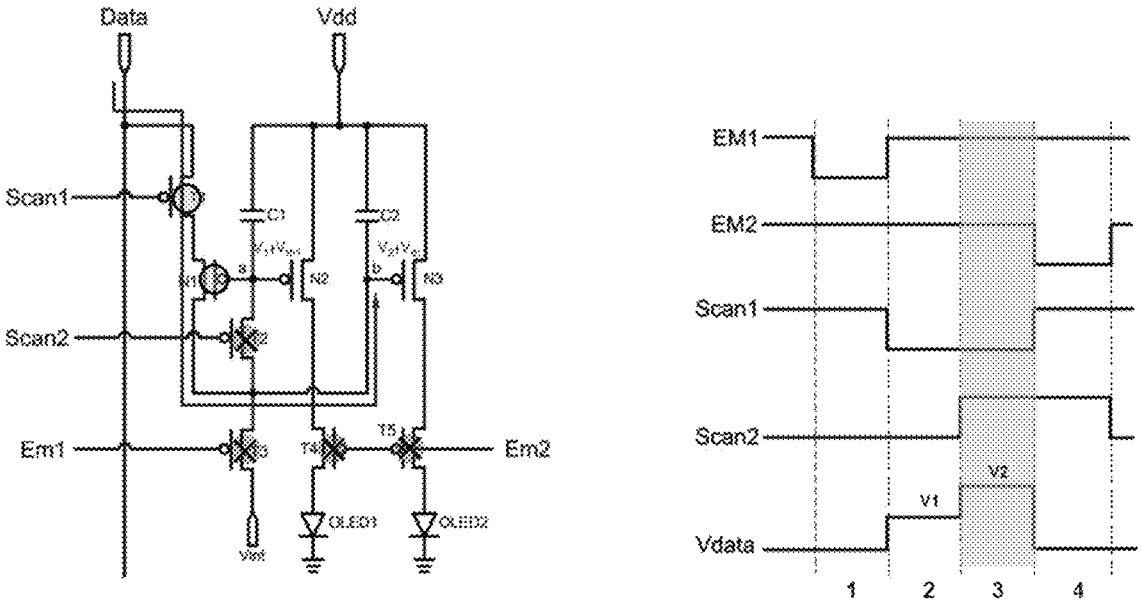

FIG. 11 illustrates the second sub-pixel charge compensation phase of the exemplary pixel circuit described above, that is, the phase 3 in the timing diagram. At this time, the signal EM1 is at a high level, the signal EM2 is at a high level, the signal Scan1 is at a low level, and the signal Scan2 is at a high level. So the reset transistor T3 is in a turning-off state, the first light emission control transistor T4 and the second light emission control transistor T5 are in turning-off states, the switching circuit transistor T1 is in a turning-on state, and the first sub-pixel switching transistor T2 is in a turning-off state. Because the first light emission control transistor T4 and the second light emission control transistor T5 are in the turning-off states, the first light emitting device LE1 and the second light emitting device LE2 do not emit light.

This figure illustrates that the data voltage Vdata from the data line is a second data voltage V2 (i.e., Vdata=V2) at this time. The voltage V2 is the gray voltage for the second sub-pixel circuit P2, and for example, the second data voltage V2>the first data voltage V1. At this time, the voltage of the first node a, i.e., the voltage of the gate electrode of the shared transistor N1, is V1+Vth1<V2+Vth1, so the shared transistor N1 is in a turning-on state, and the second data voltage V2 charges or discharges the second node b again through the shared transistor N1 until the voltage of the second node b is V2+Vth1. Moreover, because the first sub-pixel switching transistor T2 is in the turning-off state, the first node a is not charged again at this time and keeps in the state of V1+Vth1. Therefore, the second sub-pixel charge compensation phase is completed. The first node a and the second node b may be at different electric potentials corresponding to the first data voltage V1 and the second data voltage V2.

(4) The Light Emitting Phase

Figure 12:
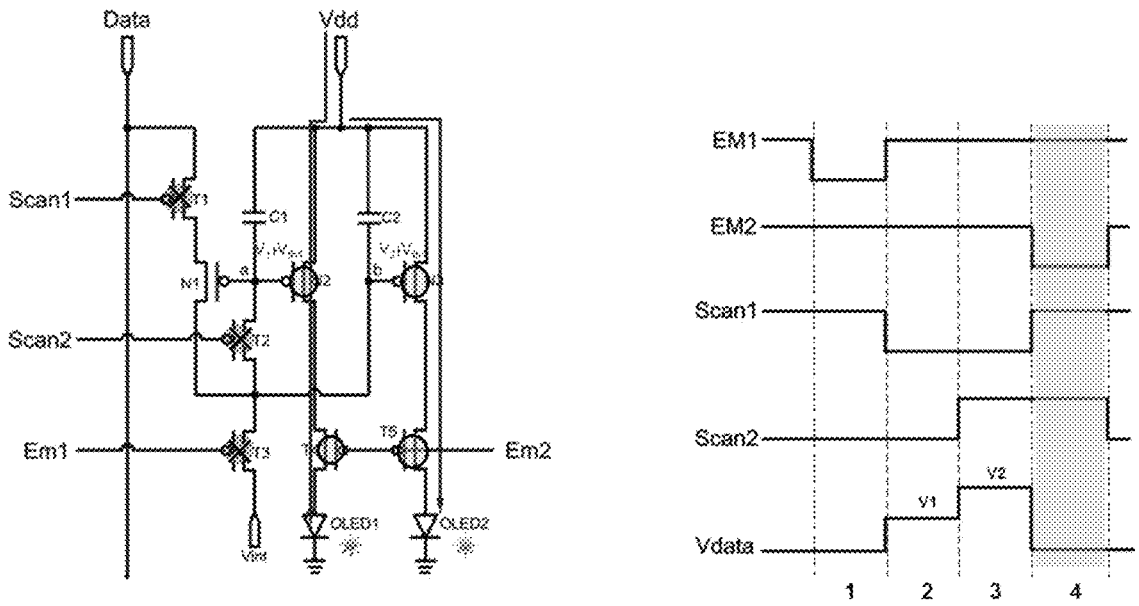

FIG. 12 illustrates the phase in which the first sub-pixel circuit and the second sub-pixel circuit of the exemplary pixel circuit described above emit light, that is, the phase 4 in the timing diagram. At this time, the signal EM1 is at a high level, the signal EM2 is at a low level, the signal Scan1 is at a high level, and the signal Scan2 is at a high level. So the reset transistor T3 is in a turning-off state, the first light emission control transistor T4 and the second light emission control transistor T5 are in turning-on states, the switching circuit transistor T1 is in a turning-off state, and the first sub-pixel switching transistor T2 is in a turning-off state. Furthermore, because the electric potentials of the first node a and the second node b are respectively V1+Vth1 and V2+Vth2, the first driving transistor N2 and the second driving transistor N3 are also in the turning-on states corresponding to the corresponding gray level at this phase. And because the first light emission control transistor T4 and the second light emission control transistor T5 are in the turning-on state, the anodes and the cathodes of both the first light emitting device LE1 and the second light emitting device LE2 are respectively input with the high voltage Vdd and the low voltage Vss, thereby emitting light under the effect of the electric currents flowing through the first driving transistor N2 and the second driving transistors N3.

More specifically, for the first sub-pixel circuit, the first driving transistor N2 is designed to be in a saturation stale during the operation phase, so the value of the electric current $I_{LE1}$ flowing through the first light emitting device LE1 may be obtained as follows:

$$I_{LE1}=K(Vgs-Vth2)^2=K[(V1+Vth1)-Vdd-Vth2)]^2\approx K(V1-Vdd)^2$$

In the above formula, Vth1 and Vth2 are the threshold voltages of the shared transistor N1 and the first driving transistor N2, respectively, and Vth1≈Vth2. Because $I_{LE1}\approx K(V1-Vdd)^2$, the electric current flowing through the first light emitting device LE1 is no longer dependent on the threshold voltage of the first driving transistor N2, but is only relevant to the data voltage Vdata (at present, the first data voltage V1) which controls the gray level of the light emission of the sub-pixel circuit, thereby realising the compensation for the first sub-pixel circuit, solving the problem of the threshold voltage (Vth) drifting due to the manufacturing process of the driving transistor and long-time operation, eliminating the influence on the operating current $I_{LE1}$, and ensuring the normal operation of the first light emitting device.

Similarly, due to Vth1≈Vth3, the calculation result of die electric current $I_{LE2}$ flowing through the second driving transistor N3 is $I_{LE2}\approx K(V2-Vdd)^2$. So the electric current flowing through the second light emitting device LE2 is no longer dependent on the threshold voltage of the second driving transistor N3, but is only relevant to the data voltage Vdata (at present, the second data voltage V2) which controls the gray level of the light emission of the sub-pixel circuit, thereby realizing the compensation for the second sub-pixel circuit, solving the problem of the threshold voltage (Vth) drifting due to the manufacturing process of the driving transistor and long-time operation, eliminating the influence on the operating current $I_{LE2}$, and ensuring the normal operation of the second light emitting device.

Moreover, as described above, according to the embodiments of the present disclosure, a same compensation circuit can be used to implement the compensation and driving of two sub-pixels. In this way, the occupied area of the compensation circuit can be reduced, and the size of the sub-pixel and the space between the sub-pixels can be greatly reduced, thereby obtaining higher image quality and higher pixel density (PPI).

For example, in one example of the present embodiment, in case that two sub-pixels display a same image, the scanning signal Scan2 may always be a low level signal, and thus the first sub-pixel switching transistor T2 is always in the turning-on state. Therefore, the first node a in the first sub-pixel circuit and the second node b in the second sub-pixel circuit are in the same situation, thereby the first light emitting device LE1 and the second large light emitting device LE2 displaying the same gray level image.

Corresponding to the above example, in another example, the difference between the pixel circuit of this example and the pixel circuit in FIG. 6 is that the first sub-pixel switching transistor T2 is not comprised. The first node a in the first sub-pixel circuit and the second node b in the second sub-pixel circuit are in the same situation, and both are directly and electrically connected to the output terminal of the shared transistor N1, thereby being charged simultaneously by the data voltage, and the first light emitting device LE1 and the second light emitting device LE2 displaying the same gray level image.

Based on the above examples, the operation methods and timings for the pixel circuits of FIG. 2, FIG. 3, FIG. 4, FIG. 5, and FIG. 7, can be accordingly obtained. For example, for the embodiment illustrated in FIG. 5, because there is no reset circuit, there is no corresponding reset phase. When a new frame is displayed, the first node a in the first sub-pixel circuit partially retains the previously-charged voltage, so the shared transistor N1 can still be in the turning-on state and can rewrite data to the first node a.

Figure 13:
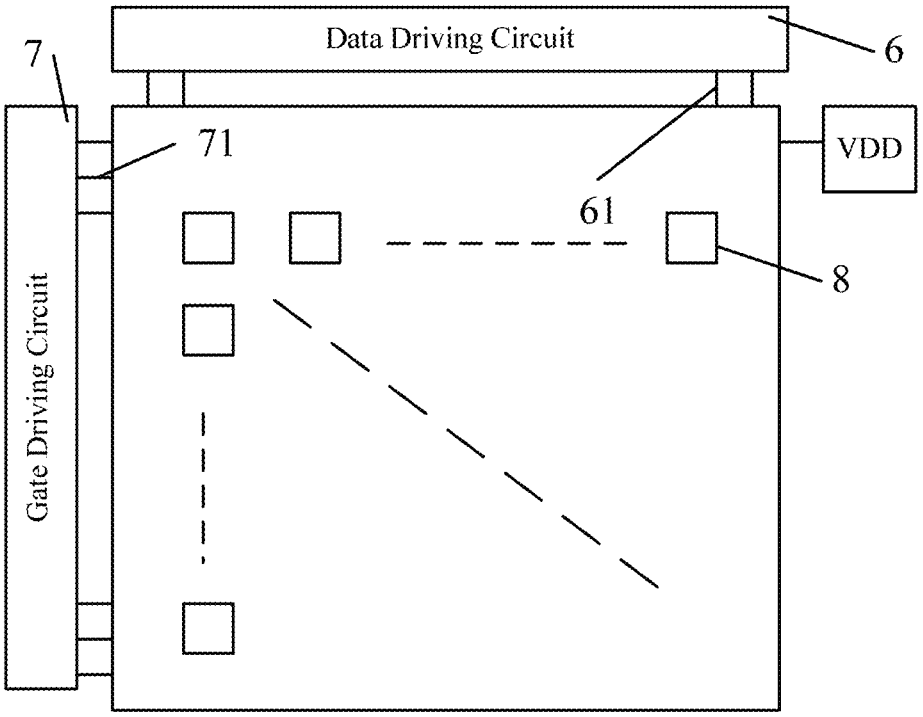
FIG. 13 is a schematic diagram of a display panel provided by another embodiment of the present disclosure.

FIG. 13 is a schematic block diagram of a display panel provided by another embodiment of the present disclosure. The display panel comprises an array of a plurality of pixel units 8, and each pixel unit 8 comprises at least two sub-pixels, for example, two sub-pixels, three sub-pixels or the like. For example, each pixel unit comprises the above pixel circuit, and at least two sub-pixels of the pixel unit respectively correspond to the first sub-pixel circuit and the second sub-pixel circuit of the pixel circuit; or, two adjacent pixel units share the above pixel circuit, one sub-pixel of one pixel unit corresponds to the first sub-pixel circuit of the pixel circuit, and one sub-pixel of the other pixel unit corresponds to the second sub-pixel circuit of the pixel circuit.

The display panel may further comprise a data driving circuit 6 and a gate driving circuit 7. The data driving circuit 6 is configured to provide data signals respectively. The gate driving circuit 7 is configured to provide scanning signals (e.g., signals Scan1~Scan3) as gate signals, and may further be configured to provide various control signals (e.g., signals Em1~Em2). The data driving circuit 6 is electrically connected to the pixel units 8 through data lines 61, and the gate driving circuit 7 is electrically connected to the pixel units 8 through gate lines 71. The data driving circuit 6 and the gate driving circuit 7 may be implemented as a semiconductor chip.

The display panel may further comprise other components such as a timing controller, a signal decoding circuit, a voltage conversion circuit, and the like. These components may use, for example, existing conventional components, which are not described in detail here.

When the light emitting device in each sub-pixel unit of the display panel is an OLED, the display panel may be an AMOLED display panel.

For example, the AMOLED display panel may be a silicon-based OLED display screen, for example, which can be used in the virtual reality (VR) or augment reality (AR) display platforms. Moreover, in the silicon-based OLED display screen, the driving circuit may be manufactured by using a manufacturing CMOS process to integrate the driving function and the display function and meet the display requirements of ultrahigh PPI.

More specifically, for example, in one example, each pixel unit 8 comprises the pixel circuit of any one of the above embodiments, and at least two sub-pixels of the pixel unit 8 respectively correspond to the first sub-pixel circuit and the second sub-pixel circuit, or further correspond to the third sub-pixel circuit.

Alternatively, in another example, one sub-pixel in one pixel unit 8 corresponds to the first sub-pixel circuit in the pixel circuit of the above embodiments (embodiments comprising the first sub-pixel switching transistor T2) illustrated in FIGS. 4-6, and one sub-pixel in another adjacent pixel unit 8 corresponds to the second sub-pixel circuit in the pixel circuit of the above embodiments illustrated in FIGS. 4-6. In this example, the resolution ratio of the display panel can be changed as needed by controlling the first sub-pixel switching transistor T2. For example, in the case that the first sub-pixel circuit and the second sub-pixel circuit emit light of the same color, when the first sub-pixel switching transistor T2 is in a turning-on state during the predetermined period (e.g., consecutive frames), the first sub-pixel circuit and the second sub-pixel circuit are configured to display the same gray level image, so that the two adjacent pixel units 8 described above are visually merged into one pixel unit, thereby the resolution ratio of the displayed image is changed to the half of the previous one, changing from a high resolution ratio to a low resolution ratio.

For the case that the resolution ratio of the display panel can be changed as needed, the display area or the selected area of the display panel may be divided into a human eye observation area and a non-observation area, so as to realize the effect of resolution ratio differentiation. For example, the display panel according to the present embodiment may further comprise an eye tracking device (e.g., comprising an image sensor, a processor, a memory, and the like) to determine the position of the display panel viewed by the human eye through the eye tracking technology. The area where the position viewed by the human eye may display with a high resolution ratio at present, but the other human eye non-observation area displays with a low resolution ratio. By differentiating the human eye observation area from the human eye non-observation area to display with different resolution ratios, the power consumption of the display panel can be effectively reduced without affecting the user's viewing experience. At this time, for example, different areas may be controlled by the same drive unit or different drive units, and different timing requirements are achieved.

What are described above is related to the illustrative embodiments of the disclosure only and not limitative to the scope of the disclosure; the scopes of the disclosure are defined by the accompanying claims.

What is claimed is:

1. A pixel circuit, comprising: a switching circuit, a shared circuit, a first sub-pixel circuit and a second sub-pixel circuit, wherein the switching circuit comprises a control terminal, a first terminal and a second terminal, the shared circuit comprises a control terminal, a first terminal and a second terminal, the first terminal of the shared circuit is electrically connected to the second terminal of the switching circuit, both the second terminal of the shared circuit and the control terminal of the shared circuit are electrically connected to the first sub-pixel circuit and also electrically connected to the second sub-pixel circuit, and the shared circuit is configured to compensate for the first sub-pixel circuit and the second sub-pixel circuit wherein the shared circuit comprises a shared transistor, the shared transistor comprises a gate electrode, a first electrode and a second electrode, the first electrode of the shared transistor serves as the first terminal of the shared circuit, the second electrode of the shared transistor serves as the second terminal of the shared circuit, and the gate electrode of the shared transistor serves as the control terminal of the shared circuit;

wherein the first sub-pixel circuit comprises a first driving transistor, a first light emitting device and a first node, the first driving transistor comprises a gate electrode electrically connected to the first node, and the first light emitting device is driven to emit light by an electric current flowing through the first driving transistor;

the second sub-pixel circuit comprises a second driving transistor, a second light emitting device and a second node, the second driving transistor comprises a gate electrode electrically connected to the second node, and the second light emitting device is driven to emit light by an electric current flowing through the second driving transistor;

both the gate electrode of the shared transistor and the second electrode of the shared transistor are electrically connected to the first node and the second node; and a threshold voltage of the first driving transistor and a threshold voltage of the second driving transistor are substantially equal to a threshold voltage of the shared transistor, and wherein the first sub-pixel circuit further comprises a first sub-pixel switching transistor, the first sub-pixel switching transistor comprises a gate electrode, a first electrode and a second electrode, and the first electrode of the first sub-pixel switching transistor and the second electrode of the first sub-pixel switching transistor are electrically connected to the second electrode of the shared transistor and the first node, respectively.

2. The pixel circuit according to claim 1, further comprising a third sub-pixel circuit, wherein the third sub-pixel circuit comprises a third driving transistor, a third light emitting device and a third node, the third driving transistor comprises a gate electrode electrically connected to the third node, and the third light emitting device is driven to emit light by an electric current flowing through the third driving transistor;

both the gate electrode of the shared transistor and the second electrode of the shared transistor are electrically connected to the third node; and a threshold voltage of the third driving transistor is substantially equal to the threshold voltage of the shared transistor.

3. The pixel circuit according to claim 2, wherein the second sub-pixel circuit further comprises a second sub-pixel switching transistor, the second sub-pixel switching transistor comprises a gate electrode, a first electrode and a second electrode, and the first electrode of the second sub-pixel switching transistor and the second electrode of the second sub-pixel switching transistor are electrically connected to the second electrode of the shared transistor and the second node, respectively.

4. The pixel circuit according to claim 2, wherein the first sub-pixel circuit further comprises a first light emission control circuit, the first light emission control circuit comprises a control terminal, a first terminal and a second terminal, and the first terminal of the first light emission control circuit and the second terminal of the first light emission control circuit are respectively electrically connected to the first driving transistor and the first light emitting device, configured to turn on or turn off an electric current flowing through the first light emitting device; and the second sub-pixel circuit further comprises a second light emission control circuit, the second light emission control circuit comprises a control terminal, a second terminal and a second terminal, and the first terminal of the second light emission control circuit and the second terminal of the second light emission control circuit are respectively electrically connected to the second driving transistor and the second light emitting device, configured to turn on or turn off an electric current flowing through the second light emitting device.

5. The pixel circuit according to claim 2, wherein the first sub-pixel circuit further comprises a first storage capacitor, and one terminal of the first storage capacitor is electrically connected to the first node for storing a voltage of the first node; and the second sub-pixel circuit further comprises a second storage capacitor, and one terminal of the second storage capacitor is electrically connected to the second node for storing a voltage of the second node.

6. The pixel circuit according to claim 1, further comprising a reset circuit, wherein the reset circuit comprises a control terminal, a first terminal and a second terminal, the first terminal of the reset circuit is configured to receive a reset voltage, and the second terminal of the reset circuit is electrically connected to the first node through the first sub-pixel switching transistor and is further electrically connected to the second node.

7. The pixel circuit according to claim 1, wherein the first subs pixel circuit further comprises a first light emission control circuit, the first light emission control circuit comprises a control terminal, a first terminal and a second terminal, and the first terminal of the first light emission control circuit and the second terminal of the first light emission control circuit are respectively electrically connected to the first driving transistor and the first light emitting device, configured to turn on or turn off an electric current flowing through the first light emitting device; and the second sub-pixel circuit further comprises a second light emission control circuit, the second light emission control circuit comprises a control terminal, a second terminal and a second terminal, and the first terminal of the second light emission control circuit and the second terminal of the second light emission control circuit are respectively electrically connected to the second driving transistor and the second light emitting device, configured to turn on or turn off an electric current flowing through the second light emitting device.

8. The pixel circuit according to claim 1, wherein the first sub-pixel circuit further comprises a first storage capacitor, and one terminal of the first storage capacitor is electrically connected to the first node for storing a voltage of the first node; and the second sub-pixel circuit further comprises a second storage capacitor, and one terminal of the second storage capacitor is electrically connected to the second node for storing a voltage of the second node.

9. The pixel circuit according to claim 1, wherein the first light emitting device and the second light emitting device emit light of different colors.

10. The pixel circuit according to claim 1, wherein the switching circuit comprises a switching circuit transistor, a first electrode of the switching circuit transistor serves as the first terminal of the switching circuit, a second electrode of the switching circuit transistor serves as the second terminal of the switching circuit, and a gate electrode of the switching circuit transistor serves as the control terminal of the switching circuit.

11. A display panel, comprising the pixel circuit according to claim 1.

12. A display panel, comprising a plurality of pixel units, wherein each pixel unit comprises at least two sub-pixels, each of the pixel units comprises the pixel circuit according to claim 1, and the at least two sub-pixels of each of the pixel units correspond to the first sub-pixel circuit and the second sub-pixel circuit of the pixel circuit.

13. A display panel, comprising a plurality of pixel units, wherein each pixel unit comprises at least two sub-pixels, two adjacent pixel units share the pixel circuit according to claim 1, wherein one sub-pixel of one pixel unit corresponds to the first sub-pixel circuit of the pixel circuit, and one sub-pixel of another pixel unit corresponds to the second sub-pixel circuit of the pixel circuit.

* * * * *